US011959340B2

(12) United States Patent
Boike et al.

(10) Patent No.: US 11,959,340 B2
(45) Date of Patent: Apr. 16, 2024

(54) ROD SECTION OF A GROUND DRILLING ROD

(71) Applicant: TRACTO-TECHNIK GmbH & Co. KG, Lennestadt (DE)

(72) Inventors: Volker Boike, Lennestadt (DE); Tobias Klein, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 17/730,281

(22) Filed: Apr. 27, 2022

(65) Prior Publication Data

US 2022/0349264 A1 Nov. 3, 2022

(30) Foreign Application Priority Data

May 3, 2021 (EP) ..... 21171872

(51) Int. Cl.
*E21B 17/046* (2006.01)

(52) U.S. Cl.
CPC ..... *E21B 17/046* (2013.01)

(58) Field of Classification Search
CPC ..... E21B 17/03; E21B 17/046; E21B 17/0465
See application file for complete search history.

(56) References Cited

U.S. PATENT DOCUMENTS 2,375,030 A * 5/1945 Joseph ..... F16D 3/20 464/155
3,986,570 A * 10/1976 Stinson ..... E21B 17/046 175/320
4,010,966 A 3/1977 Vanden Bosch
4,019,590 A * 4/1977 Hansen ..... E21B 17/00 175/320
5,125,692 A * 6/1992 Sinclair ..... E21B 21/16 285/123.3
7,147,065 B2 * 12/2006 Tjader ..... E21B 7/064 175/320
2007/0045007 A1 * 3/2007 Tjader ..... E21B 7/064 175/320
2009/0127000 A1 * 5/2009 Cousins ..... E21B 17/046 175/78
2010/0044113 A1 * 2/2010 Leblanc ..... E21B 17/03 175/325.2
2012/0267170 A1 * 10/2012 Langenfeld ..... F16L 15/08 175/57
2014/0353045 A1 * 12/2014 Zhang ..... E21B 17/042 175/320

(Continued)

FOREIGN PATENT DOCUMENTS

DE 20012524 U1 10/2000
DE 102006019396 A1 10/2007

(Continued)

*Primary Examiner* — David Carroll
(74) *Attorney, Agent, or Firm* — Leason Ellis LLP

(57) ABSTRACT

The invention relates to a rod section of a ground drilling rod, wherein the rod section is configured at the end to form a plug connection and has (a) a male connector or (b) a female connector at at least one end, wherein the male connector has at least one circular portion and at least one more straight-line-like portion in cross section on the outside, or the female connector has at least one circular portion and at least one more straight-line-like portion in cross section on the inside.

17 Claims, 4 Drawing Sheets

(56) References Cited

U.S. PATENT DOCUMENTS

| | | | | |
|---|---|---|---|---|
| 2015/0176342 | A1* | 6/2015 | Ficken | E21B 17/03 464/152 |
| 2018/0313171 | A1* | 11/2018 | Vos | E21B 7/062 |
| 2019/0195286 | A1 | 6/2019 | Marchand et al. | |
| 2020/0141191 | A1 | 5/2020 | Wurm et al. | |

FOREIGN PATENT DOCUMENTS

| | | | |
|---|---|---|---|
| DE | 10 2011 010 958 | A1 | 8/2012 |
| EP | 36 47 531 | A1 | 5/2020 |
| GB | 2106608 | A | 4/1983 |
| WO | 02/08565 | A1 | 1/2002 |

* cited by examiner

ROD SECTION OF A GROUND DRILLING ROD

The invention relates to a rod section of a ground drilling rod, to a ground drilling tool, to the use of a rod section or a ground drilling tool, and to a method for drilling a borehole in the ground.

In the case of rod-based drilling in the ground, in particular for the production of so-called horizontal bores which can run substantially parallel to or at a relatively small angle of inclination to the ground surface, a drill head or drill tool is propelled by means of a drilling rod by a drive device arranged on the ground surface or in a construction pit. The drilling rods used in this case usually consist of individual, interconnected rod sections, which—according to the drilling path—are gradually attached to the rear end of the drilling rod that has already been drilled and connected thereto.

Different configurations are known for interconnecting the rod sections. The rod sections can be connected by means of a threaded connection and/or a plug connection.

It is known from DE 10 2011 010 958 A1 to specify a possibility for connecting two rod sections of a drilling rod which combines the advantages of the threaded connections known from the prior art and the axial plug connections. A plug connection is described which—similar to a threaded connection—is based on helical projections/grooves running on a threaded male connector with a circular cross section or in a corresponding threaded female connector, the projections/grooves being designed so that the self-locking characteristic of a threaded connection does not occur.

Proceeding from this prior art, the invention was based on the object of specifying an improved plug connection for a ground drilling rod, in particular a rod section or ground drilling tool, and on a use, and on a method. In particular, increased strength and/or reduced susceptibility to wear compared to other plug connections when drilling in the ground can be achieved.

This object is achieved by the subject matter of the independent claims. Advantageous embodiments are the subject matter of the corresponding dependent claims and/or emerge from the following description of the invention.

A (first) aspect of the invention, which aspect in itself may constitute the basis of the invention or patent, relates to the configuration of the male connector and/or female connector of a plug connection of a ground drilling rod. According to this aspect, the outside cross section of the male connector or the inside cross section of the female connector has at least one circular portion and at least one more straight-line-like portion. Surprisingly, such a shape is suitable for ground drilling with the resulting high loads and can have a corresponding strength or reduced wear, with the circular portion or circular portions in particular not having to be involved in torque transmission. The torque transmission can take place via the more straight-line-like portion or portions. Although not the entire length of the cross section or not the entire circumference is available for torque transmission due to the at least one more straight-line-like portion, the plug connection can meet the high requirements for ground drilling in terms of load, wear, and/or service life, which is surprising. With the surprising, suitable shape, a shape can be selected in which there can be a relatively small (conceptual) deviation from the shape of an overall circle. For example, there can be additional (building) space compared to a purely square design—e.g. in the corners which cannot be present because a circular portion is provided there—with the (building) space being available for another use, e.g. for laying or forming one or more channels for drilling fluid, a data line, and/or a power line in the rod section. A simple creation of the cross section or circumference of the plug connection or the element of the plug connection can be made possible since the cross section or circumference can only have a low level of complexity and can be created or manufactured using simple production machines, in particular NC machines. A simple construction can be made possible for the user.

A rod section of a ground drilling rod is proposed, which is configured at the end to form a plug connection and has (a) a male connector or (b) a female connector at at least one end, wherein the male connector has at least one circular portion and at least one more straight-line-like portion in cross section on the outside, or the female connector has at least one circular portion and at least one more straight-line-like portion in cross section on the inside.

A further (second) aspect of the invention, which aspect in itself may constitute the basis for the invention or patent, relates to the configuration of the male connector and/or female connector of a plug connection of a ground drilling rod, with the outside cross section of the male connector or the inside cross section of the female connector having at least one portion on which a contact surface for a securing element of the plug connection is configured. In this aspect, the invention has broken with the usual procedure of providing a securing element in a solid portion or a core or arranging the securing pin in such a way that it substantially extends through a center point of the ground drilling rod in order to be able to obtain the largest possible contact surface. It has been found that the arrangement of the securing element or securing elements described here is sufficient for many applications.

A rod section of a ground drilling rod is proposed, which is configured at the end to form a plug connection and has (a) a male connector or (b) a female connector at at least one end, and the male connector has a cross section on the outside, or the female connector has a cross section on the inside, wherein the cross section has at least one portion on which a contact surface for a securing element of the plug connection is configured.

The two aforementioned aspects can be freely combined with one another, so that the cross section of the plug connection for the male connector and/or female connector can have the shape described, and at least one contact surface for a securing element is provided on a portion of the cross section.

The term "rod section" in the context of the invention comprises an element which extends along a longitudinal axis and which can be part of a ground drilling rod or a drill string for the soil. The rod section can be designed as an element which is arranged at the front side in the drill string and has an associated function (contains a transmitter for locating and/or is configured as a front-side drill tool or similar) or as an element that merely lengthens the drill string as a "normal" rod section. The rod section can comprise mechanical channels, for example for drilling fluid, electrical lines, electrical elements, and/or electronic elements. Another (special) function of the rod section is not excluded.

A rod section can have a first end with a described configuration. The rod section (in particular when not configured as a front-side ground drilling tool) may have a second end spaced apart from the first end which may be configured for connection to another rod section or a ground drilling tool. The rod section may further include a center line extending from the first end to the second end and extending along the rod section. The cross section under consideration of the male connector or the female connector can in particular be a cross section perpendicular to the center line of the rod section.

Within the context of the description, the rod section can in particular be a double-pipe rod section in which both a so-called inner rod and a so-called outer rod are present. In the case of such a double-pipe rod, a drill head or ground drilling tool can also be driven in rotation via the inner rod by the drive device arranged on the ground surface or in a construction pit, which also provides for the propulsion of the drill head or ground drilling tool. For this purpose, the inner rod can be mounted rotatably within the outer rod of the double-pipe rod. The outer rod in a double-pipe rod is usually either not rotated at all or only at a low speed. The rotations of the outer rod and inner rod can be performed independently. A double-pipe rod is particularly suitable for a rock drilling device, whereby the wear of the drilling rod can be limited, because the outer rod in contact with the rocky bore wall can be advanced along the rocky bore wall without rotation or only at low speed, while the inner rod driven with a higher speed can be mounted in the outer rod to reduce wear. If the configuration relates to a double-pipe rod section, the inner rod and/or the outer rod of the double-pipe rod section can be configured at at least one end, as described in the description.

The term "ground drilling rod" in the context of the description comprises a drilling rod that can be moved through the ground by means of a ground drilling device. In particular, the ground drilling rod can be moved in a pushing or pressing manner through the ground. The ground drilling rod can be a rod having rod sections that can be moved in an existing channel or in a channel to be created in the ground in order to create or widen a bore, in particular a horizontal bore, or to introduce pipes or other elongate bodies in the ground. In addition to the in particular pushing force, provision can also be made for the ground drilling device to drive the ground drilling rods in rotation. In particular, the ground drilling rod can have a ground drilling tool at the front-side end which first comes into contact with the ground.

The term "ground drilling device" in the context of the description comprises any device that can move a ground drilling rod in an existing channel or in a channel to be created in the ground, in order to create or widen a bore, in particular a horizontal bore, or to drive pipes or other elongate bodies into the ground. A ground drilling device can comprise a drive device or drive which drives a drill string in a pulling and/or pushing manner. Additionally or alternatively, it can be provided that the drive device drives the drill string in a rotational manner.

The term "horizontal drilling" in the context of the present description comprises in particular any type of, preferably horizontal, existing channels or channels to be created in a body, in particular underground channels including boreholes, rock bores, or underground pipes as well as underground or above-ground pipelines and water channels that can be created or introduced using a corresponding ground drilling device.

The term "plug connection" in the context of the description comprises, in particular, a positive connection of two elements of the ground drilling rods or two rod sections, in particular a rod section with a ground drilling tool, which connection is formed in the direction of rotation about the center line or longitudinal axis, in which ground drilling tool a plug element, formed at one end of one element of the ground drilling rod, of the plug connection, can be plugged positively into another plug element, formed on the other element of the ground drilling rod, of the plug connection. The plug elements can be brought into a positive connection with one another, whereby a torque transmission between the two elements of the ground drilling rod is possible.

In a preferred embodiment, the plug connection is aligned coaxially with the rod section or the ground drilling tool, as a result of which a simple configuration can be achieved. The plug connection can be rotationally invariant, in particular if the female connector and male connector substantially have angular symmetry of rotation, so that the female connector and/or male connector can be realigned by means of a rotation of less than 360° about the longitudinal axis or central axis of the rod section or the ground drilling tool. In particular, a rotational invariance of 180° or 90° can be provided. The construction of the female connector and/or male connector is not complex. The handling of the plug connection can be simplified on a construction site and thus in difficult conditions.

A separation of the force-transmitting portions can be achieved on an element of the ground drilling rod. Compressive forces can be transmitted, for example, via a stop on the plug connection between the female connector and the male connector. The stop for transmitting the compressive forces can be formed by means of an edge of the female connector and/or the male connector which are at least partially in contact with one another when plugged together. Rotational forces or a torque can be transmitted via the cross-sectional profile formed within the plug connection between a male connector and a female connector. Tensile forces can be transmitted via a securing element of the plug connection, for which purpose contact surfaces for the securing element can be formed on the corresponding element of the ground drilling rod.

In the context of the description, the terms "male connector" and "female connector" comprise a configuration as one element of a pair of mechanical coupling elements, one of which ("male connector") can be inserted at least partially into the other ("female connector") in order to form the connection. The "male connector" does not necessarily have to comprise an element with a filled or solid cross section, but it is also provided in particular that the inserted element can have a hollow core. The male connector may have a free interior region; the male connector may be configured in a cylindrical shape with a shell inside in which there can be free space.

The term "cross section" in the context of the description comprises a sectional view transverse to the longitudinal direction of the male connector or female connector, which longitudinal direction is transverse to the center line of the rod section or ground drilling tool. In particular, the cross section can be viewed at an angle of substantially 90° to the center line.

In this respect, the cross section on the outside of a male connector can be a cross section that is at least partially configured for torque transmission to the female connector. The outside cross section may be at least partially engaged with an inside cross section that at least partially conforms to the outside cross section.

The inside cross section of a female connector may be a cross section that is at least partially configured for torque transmission to the male connector. The inside cross section may be at least partially engaged with an outside cross section that at least partially conforms to the inside cross section.

The term "circular portion" comprises a portion that may substantially conform to the shape of a portion of a circle; in particular, the portion can be designed in such a way that a torque in the case of a plug connection cannot or could not be transmitted or only to a very small extent, for example via static friction, by means of the portion configured on the cross section. The shape of a circular portion itself can be designed in such a way that torque transmission cannot or could not take place.

The term "more straight-line-like portion" comprises a portion that substantially has a shape that differs from the "circular portion," wherein, with the geometric configuration of the shape as a "more straight-line-like portion," a torque transmission is possible for a plug connection by means of the portion configured on the cross section. The "more straight-line-like portion" can substantially correspond to a straight line, with a slight curvature being able to be provided.

With regard to the distinction between "circular portion" and "more straight-line-like portion," a distinction can be such that the radius of curvature of the two portions, which can be formed on a cross section or circumference, differs. The "more straight-line-like portion(s)" can in particular have a curvature that corresponds to between 0% (not curved, straight line) and 50% of the curvature (only ½ times curved) of the circular portion. It is possible to refer to the "more straight-line-like portion(s)" as "torque-transmitting portion(s)" because torque is transmitted between the elements of the plug connection substantially through the "more straight-line-like portion(s)."

It may be possible that the cross section may have a plurality of circular portions which may have a substantially equal radius of curvature relative to substantially the same point. The portions that are more straight-line-like can be designed as substantially straight portions with a small curvature, i.e. a higher radius of curvature with different centers of curvature, wherein all portions that are more straight-line-like can preferably have the same radius of curvature. Provision can be made for the more straight-line-like portions to be designed in the form of straight lines, in particular substantially as secants on a circle that forms portions for the circular portions. The cross section can initially be constructed—in a first step—as a circle in the construction, with portions of the circle forming the circular portions and the more straight-line-like portions inserted between the portions of the circle (circular portions can be replaced by more straight-line-like portions) and thus together form the cross section for the plug connection. In a particularly preferred embodiment, the cross section is point-symmetrical to the center through which the longitudinal axis of the plug connection or the longitudinal axis of the rod section runs, consisting of circular and more straight-line-like portions. As an alternative or in addition, the cross section can have an axisymmetric design, with the axis of symmetry running transversely to the longitudinal axis, intersecting the center point. There can be several axes of symmetry. Provision can be made for the number of circular portions and more straight-line-like portions to be the same and in particular to be four.

In a preferred embodiment, the circular portion and the more straight-line-like portion are interconnected in a continuous or smooth manner, with the term "continuous" or "smooth" describing a property of the cross section in the context of the description, according to which the cross section has substantially no discontinuities, i.e., the change in the function values describing the cross section can be limited at will by restricting to sufficiently small changes in the argument, for example in the polar angle. The term "continuous" or "smooth" refers to a macroscopic consideration, in which minor, in particular microscopic, discontinuities may be present, but in particular a radially running macroscopic portion or a plurality of radially running macroscopic portions can be excluded or may not be present. "Continuous" or "smooth" can describe or refer to a cross section that has no edges or is configured without edges.

In a preferred embodiment, the more straight-line-like portion has a radius of curvature that is more than 1.5 times, in particular more than 2 times, larger than the radius of the circular portion. As a result, a separation of torque-transmitting and non-torque-transmitting portions can be achieved, which can be easily constructed and manufactured with simple means.

In a preferred embodiment, the more straight-line-like portion intersects a circular portion having a radius less than the radius of the circular portion. A simple construction of the plug connection or the elements of the plug connection is possible.

In a particularly preferred embodiment, the cross section is at least partially configured to be P4C-shaped.

The concept of a configuration of a cross section as "P4C-shaped" in the context of the description comprises the well-known polygonal profile P4C, with deviations from the pure shape being possible, which deviations are caused in particular by tolerances during production. Insofar as it is described that the cross section "at least partially" substantially has the described shape, this comprises that in particular (circumferential) portions of the cross section may be present that are not configured to be P4C-shaped. It can be important that the P4C-shaped portions of the cross section can be present, but other portions can also be present. In particular, a P4C-shaped cross section can be characterized in that it can be configured to be P4C-shaped at torque-transmitting portions of the cross section. A P4C-shaped cross section can also have a torque-non-transmitting portion or a plurality of these portions which can be configured differently than the P4C-shape dictates without impairing the function of the torque transmission.

By means of the described configuration of the cross-sectional shape, a plug connection can be created through which a very high torque can be transmitted, whereby it can be achieved that the two elements of the ground drilling rod to be connected touch each other over a large surface in relation to the cross section, so that a significantly reduced surface pressure can occur. A notch effect can be avoided.

The configuration of the cross section as at least partially P4C-shaped in the circumferential direction on the female connector and/or male connector is not necessarily present over the entire length of the female connector and/or the male connector, but can extend over the entire length.

The term "contact surface" in the context of the description comprises a surface for which an element, in particular the securing element which is at least partially adapted to the shape of the contact surface, can be present. A connection can be realized by the contact of the element or securing element on the contact surface. The contact surface can have a surface region that runs transversely to the longitudinal direction of the rod section or ground drilling tool.

The term "securing element" in the context of the description comprises a component that causes two elements to be secured to one another, in which the securing element rests in particular against a contact surface of one of the two elements, in particular on a contact surface of each of the two elements. The securing element can be inserted into the plug connection formed to rest on the contact surface(s). The securing element can extend through or be inserted into a bore running through the female connector and male connector. The securing element can be an elongated or rod-shaped element which can be introduced into the male connector and female connector. The securing element can at least partially form a non-positive, positive, and/or material connection with the contact surfaces, so that the plug connection can be fixed in the longitudinal direction of the plug connection by means of the securing element. The securing element can be screwed, inserted, pushed, pressed, and/or glued into or onto the contact surface(s). The securing element can be configured as a dowel pin, the diameter of which is chosen so that it can be compressed by a desired amount when installed. The dowel pin can be inserted into a bore in the male connector and female connector that are aligned with one another. The contact surface(s) described can be produced by means of a bore. A dowel pin can be easily installed and uninstalled. In addition, a contact surface or contact surfaces for the dowel pin can be well designed and manufactured. A dowel pin allows assembly/disassembly without special tools.

The term "bore" in the context of the description comprises a depression or a breakthrough that can be configured to be round in cross section. The term bore also comprises a depression and/or a breakthrough that is not completely surrounded by material. In particular, no material can be present in a direction that does not impair the securing function. The term bore also comprises a recess in a direction transverse to the longitudinal direction of the female connector or the male connector, so that the bore or recess has a contact surface which interacts with the securing element in the event of a tensile load. The bore or recess can rest against the securing element with its contact surface. The term bore is not limited to a recess, a depression, or a recess that is produced by means of a rotating tool with the corresponding mechanical removal of chips or fragments, but also comprises production carried out by spark erosion, vibrating lapping, and/or by means of a laser.

In a preferred embodiment, in the case of the rod section, the plug connection can be realized by means of a female connector which has a through-hole for inserting the securing element. In this way, easy access can be made possible in that the securing element can extend through the female connector. For example, the securing element can be inserted on one side of the through-hole and ejected on the other side. In a preferred embodiment, the through-hole is arranged in such a way that the longitudinal axis of the through-hole describes an angle with a line passing through the center line of a cross section. The through-hole can extend in such a way that the longitudinal axis of the through-hole does not intersect the center line of the rod section or the ground drilling tool. The through-holes can be formed circumferentially on the inside cross section. A plurality of through-holes are preferably formed circumferentially on the inside cross section, which through-holes can substantially have an equidistant distance from one another. The (through-)hole can be a secant of the cross section. In a particularly preferred embodiment, there is more than one through-hole. For example, there can be a through-hole for each securing element. In particular, the through-hole can be formed in a region of the cross-sectional profile that is not used for the torque-transmitting function of the inside cross section of the plug connection. For example, two through-holes for two securing elements, three through-holes for three securing elements, and in particular four through-holes for four securing elements can be provided. The securing elements may be spaced apart around the circumference of the inside cross section of the female connector; the through-holes or the securing elements are circumferentially distributed around the cross section. In a particularly preferred embodiment, there are four through-holes, in particular with a P4C-shaped cross section which can be provided in particular in regions that are not intended for the torque-transmitting function.

In a preferred embodiment, the rod section has a transmitter which, in particular, allows the ground drilling rod to be located. A rod section having a transmitter is usually arranged in the front region of the ground drilling rod. In most cases, the rod section having a transmitter is used as the rod section which is arranged behind the ground drilling tool.

In a preferred embodiment, the rod section or the ground drilling tool has another connection at the other end spaced apart from the end for connection to a further rod section. This makes it possible to switch to a different type of connection on the other side of the rod section.

In a preferred embodiment, the rod section is designed as a double-pipe rod section. In a particularly preferred embodiment, the plug connection is present on the outer rod section of the double-pipe rod section. As a result, variability and flexibility can be achieved. The inner rod section can be connected to the plug connection differently than in the present case. It can be based on different possible uses or requirements.

The configuration described with regard to the cross-sectional shape is not limited to a portion of a ground drilling rod that is usually referred to as a rod section, but can also relate to the configuration of a ground drilling tool, so that, according to an aspect that is the basis of the invention in and of itself, it can relate to a ground drilling tool that has a male connector and/or may have a female connector for forming a plug connection of a ground drilling rod. According to this aspect, the outside cross section of the male connector or the inside cross section of the female connector of the ground drilling tool is at least partially formed into a P4C shape.

The term "ground drilling tool" comprises a drill head arranged at the front-side end of the ground drilling rod or drill string, in which moving parts can be provided. However, it can also be provided that the ground drilling tool has an immovable or rigid or largely immovable or rigid outer contour.

A ground drilling tool is described, which is configured at the end to form a plug connection and has (a) a male connector or (b) a female connector, wherein the male connector has at least one circular portion and at least one more straight-line-like portion on the outside, or the female connector has at least one circular portion and at least one more straight-line-like portion on the inside.

The configuration described with regard to the contact surface on at least one portion of a cross section is not limited to a rod section per se, but can also relate to the design of a ground drilling tool, so that, according to an aspect that is the basis of the invention, a ground drilling tool has a male connector and/or a female connector for forming a plug connection of a ground drilling rod, a contact surface for a securing element of the plug connection being configured on at least one portion on the outside cross section of the male connector or on the inside cross section of the female connector.

A ground drilling tool is described which is configured at the end to form a plug connection and has (a) a male connector or (b) a female connector, and the male connector has a cross section on the outside, or the female connector has a cross section on the inside, wherein the cross section has at least one portion on which a contact surface for a securing element of the plug connection is configured.

In a preferred embodiment, the ground drilling tool is suitable for drilling a pilot bore, in particular a rock bore. This means that ground drilling tools can be used, which are usually only introduced in a pushing or pressing manner through the ground. When drilling a rock bore or a pilot bore, slight tensile forces can act, which can then be transmitted by means of the securing element or the securing elements and the corresponding contact surfaces.

The invention also relates to a drilling rod portion of a ground drilling rod in which a rod section configured in accordance with the description is connected to a ground drilling tool configured in the context of the description.

The invention also proposes a use of a rod section or a ground drilling tool in which the rod section or the ground drilling tool is configured at the end to form a plug connection and has (a) a male connector or (b) a female connector at at least one end, wherein at least one circular portion and at least one more straight-line-like portion is provided for the male connector on the outside or the female connector on the inside.

The invention also proposes using a rod section or a ground drilling tool in which the rod section or the ground drilling tool is configured at the end to form a plug connection and has (a) a male connector or (b) a female connector at at least one end, and the male connector has a cross section on the outside or the female connector has a cross section on the inside, wherein a cross section is used which has at least one portion on which a contact surface is configured for a securing element of the plug connection.

The two aforementioned uses can be freely combined with one another, so that the cross section of the plug connection for the male connector and/or female connector can have the shape described and at least one contact surface for a securing element is provided on a portion of the cross section.

The invention also proposes a method for drilling a borehole in the ground, wherein a rod section or a ground drilling tool is provided, wherein the rod section or the ground drilling tool is configured at the end to form a plug connection and has at one end (a) a male connector or (b) a female connector, and the cross section of the male connector has at least one circular portion and at least one more straight-line-like portion on the outside, or the cross section of the female connector has at least one circular portion and at least one more straight-line-like portion on the inside.

The invention also proposes a method for drilling a borehole in the ground, wherein a rod section or a ground drilling tool is provided, wherein the rod section or the ground drilling tool is configured at the end to form a plug connection and has (a) a male connector or (b) a female connector at at least one end, and the male connector has a cross section on the outside, or the female connector has a cross section on the inside, wherein a cross section is provided which has at least one portion on which a contact surface for a securing element of the plug connection is configured.

The two aforementioned methods can be freely combined with one another, so that the cross section of the plug connection for the male connector and/or female connector can have the shape described, and at least one contact surface for a securing element is provided on a portion of the cross section.

If a device, in particular in the form of a rod section or a ground drilling tool, a method, and a use are described in the description, the explanations of the individual aspects complement each other. In particular, the explanations of the device, in particular with regard to the features of the same, also apply to the method and to the use.

Numerical information in the context of the description is information that may have a tolerance of +/−10%, so that the numerical information not only describes one value, but a range of values, in particular to take account of tolerance ranges that may be production-related.

Like the following description of an embodiment, the above statements do not constitute a waiver of specific embodiments or features.

The invention is explained in more detail below with reference to an embodiment shown in the drawings in which.

Figure 1:
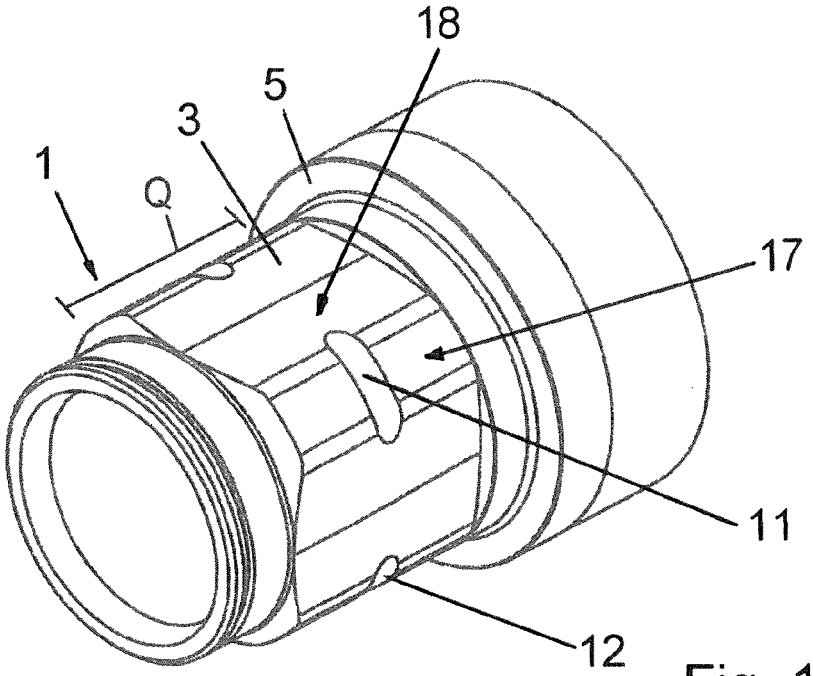
FIG. 1 is an isometric view of a male connector.
Figure 2:
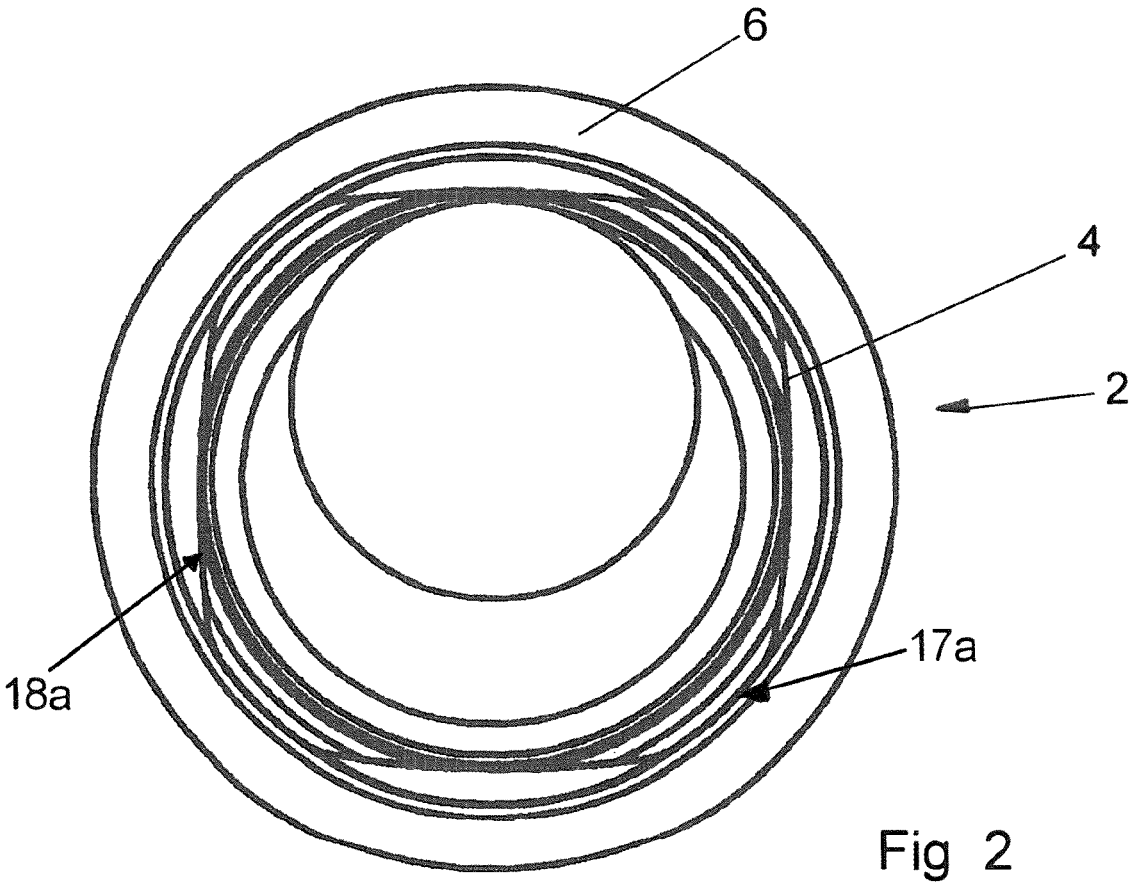
FIG. 2 is a view of a female connector in the direction of the center line of the female connector.

FIG. 1 is a schematic isometric view of a male connector 1, as can be formed at the end of a rod section or a ground drilling tool. The end of the rod section or ground drilling tool is configured to form a plug connection. In the embodiment shown, the male connector 1 is part of a pair which also has a female connector 2, as is described in particular in connection with FIGS. 2 and 3.

FIG. 1 shows a cross section 3 on the outside of the male connector over a length Q, which cross section is adapted to a cross section 4 on the inside of the female connector 2.

The outside cross section 3 of the male connector 1 and the inside cross section 4 of the female connector 2 have four circular portions 17, 17*a* and four more straight-line-like portions 18, 18*a*. The four circular portions 17, 17*a* and the four more straight-line-like portions 18, 18*a* of a circumference and cross section respectively result in a P4C-shaped configuration. Over the length Q, the male connector 1 and the female connector 2 interact by means of the P4C-shaped cross section to transmit a torque from the male connector 1 to the female connector 2 and vice versa.

A pressing force can be transmitted between the female connector 2 and the male connector 1 by means of abutment surfaces 5, 6 which lie against one another when plugged together.

In order to form a securing mechanism for the plug connection, bores are made in the male connector 1 and the female connector 2 into which a securing element can be inserted.

Figure 3:
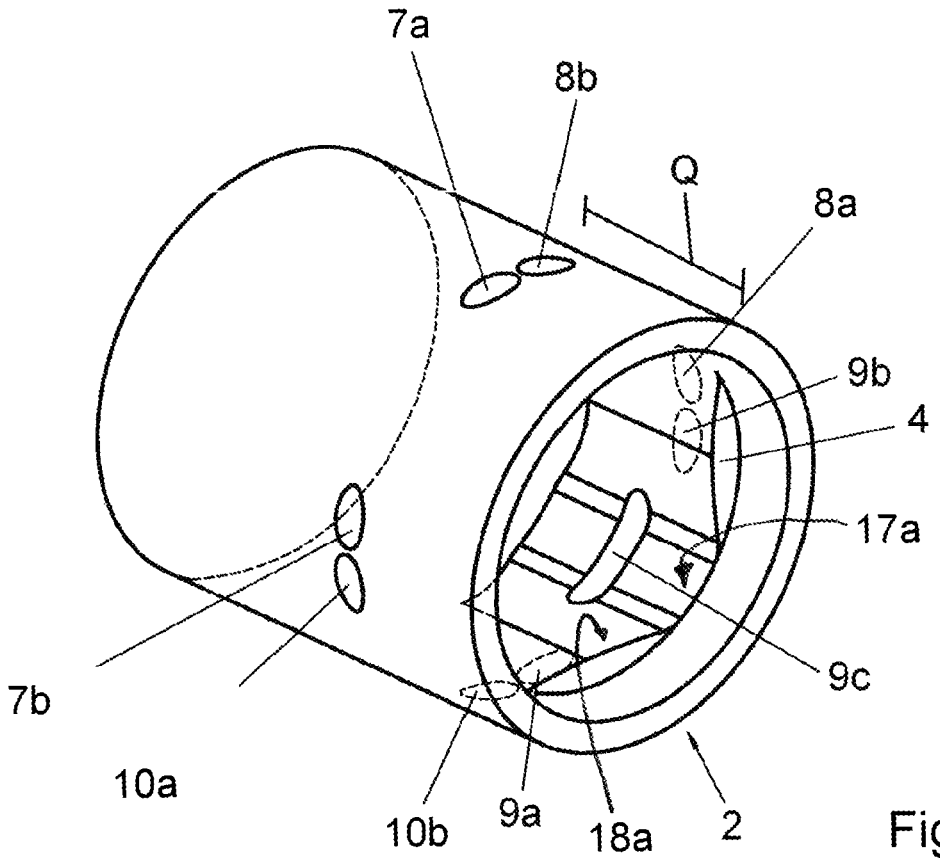
FIG. 3 is an isometric view of the female connector of FIG. 2.
Figure 4:
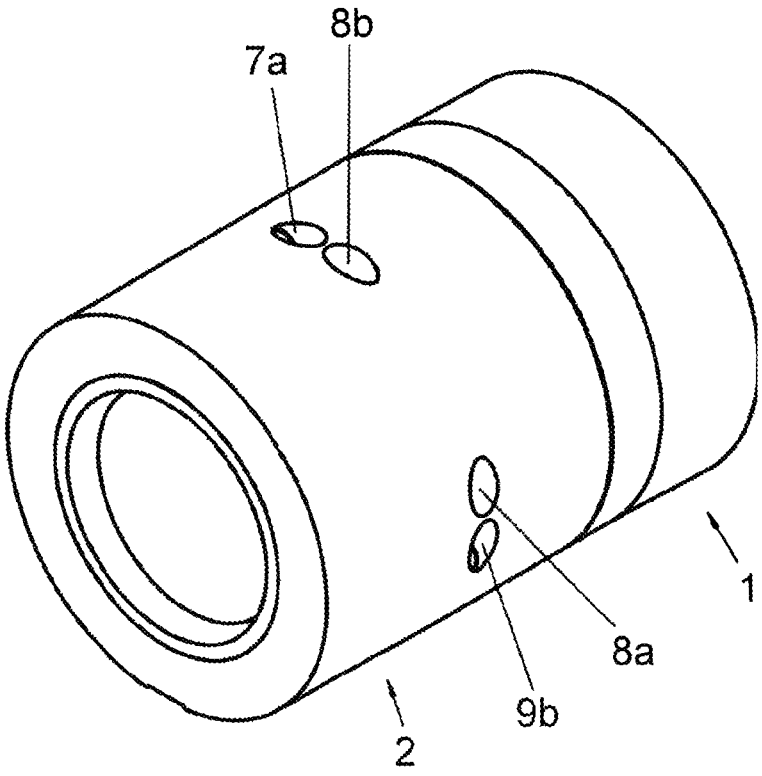
FIG. 4 is a side view of an interlocking plug connection of the male connector according to FIG. 1 and female connector of FIGS. 2 and 3.

The bores are formed in the female connector 2 by means of through-holes 7, 8, 9, 10. In the outer edge region, the through-holes come out at the holes 7*a*, 7*b*, 8*a*, 8*b*, 9*a*, 9*b*, 10*a*, 10*b*. In the female connector 2, open recesses are formed by the bores in the inside cross section 4, of which bores a recess 9*c* is shown in FIG. 3.

On the male connector 1, the bores lead to recesses 11, 12 with a corresponding contact surface for the securing element.

The bores or recesses 7, 8, 9, 10, 11, 12 are formed in the cross-sectional portion or region in which the P4C-shaped cross section does not have the function of torque transmission.

Figure 5:
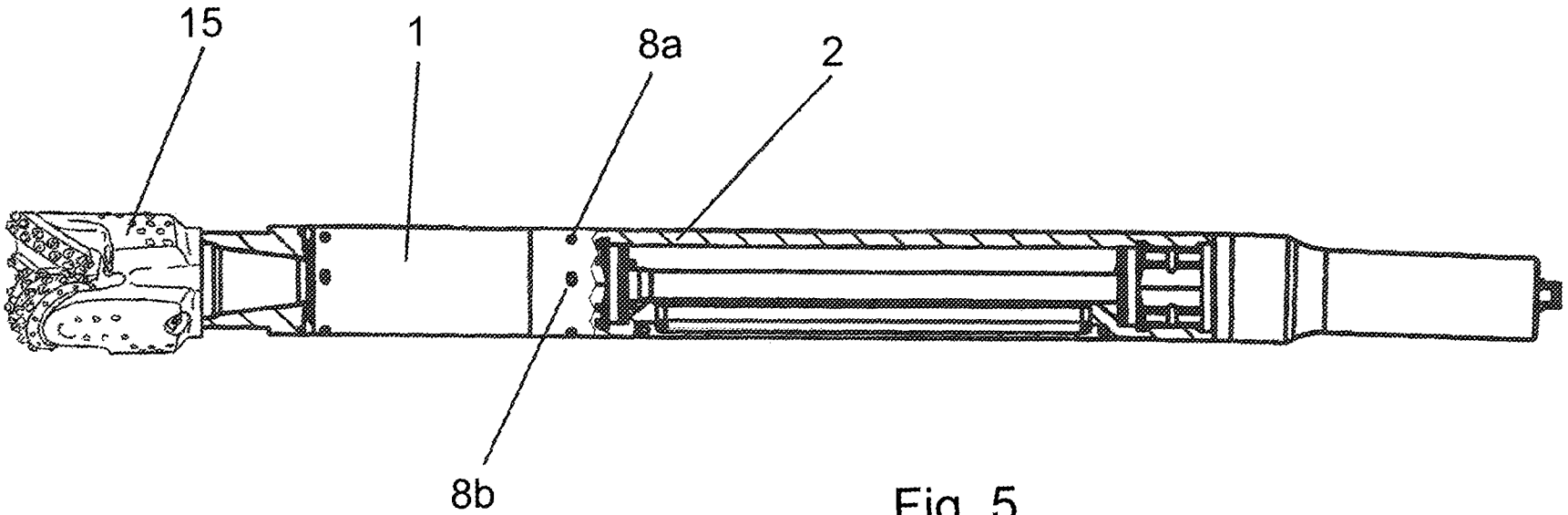
FIG. 5 is a front-side portion of a double-pipe ground drilling rod in partial section.
Figure 6:
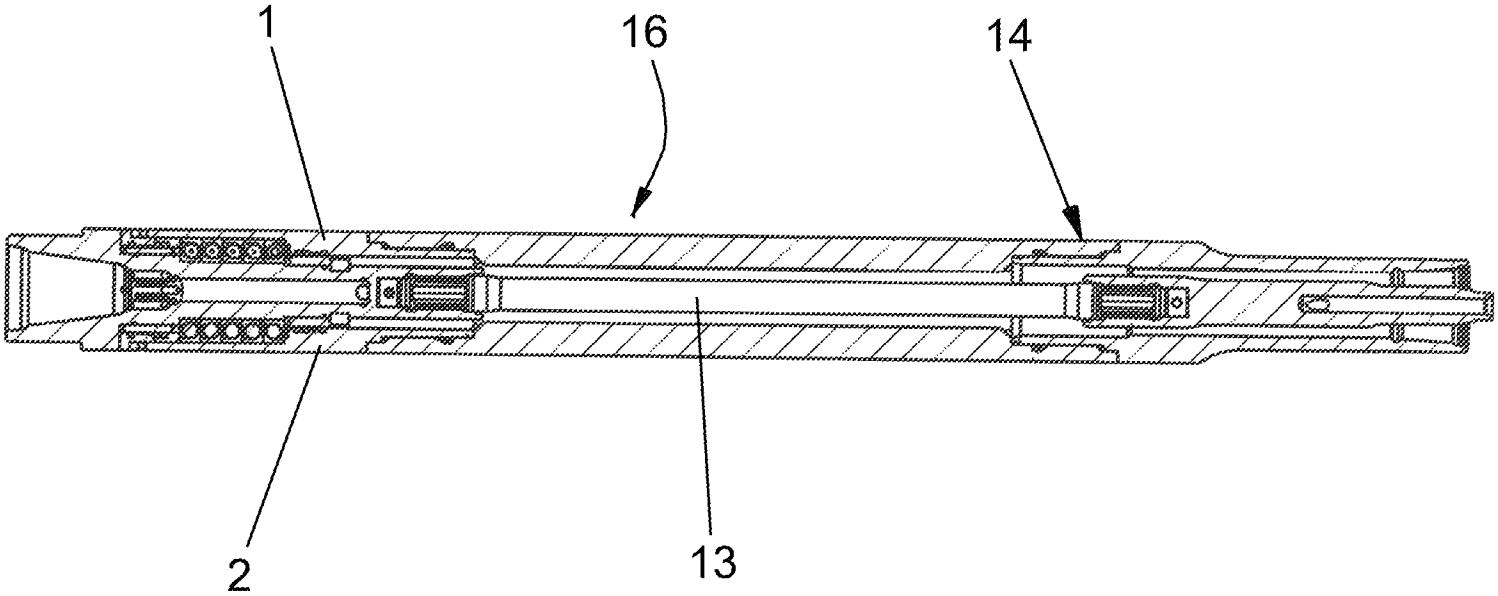
FIG. 6 is a detailed view of FIG. 5.

FIGS. 5 and 6 show a double-pipe rod section 16, comprising an inner rod section 13 and an outer rod section 14.

The outer rod section 14 of the double-pipe rod section 16 is connected to a ground drilling tool 15 by means of a plug connection as described above.

The invention claimed is:

1. A ground drilling rod comprising a rod section, wherein the rod section is configured at a first end to form a plug connection and wherein the rod section has (a) a male connector or (b) a female connector at the first end, wherein the male connector has at least two circular portions and at least two more straight-line-like portion in a cross section on the outside, or the female connector has at least two circular portions and at least two more straight-line-like portions in a cross section on the inside, wherein the at least two circular portions of the male connector or the at least two circular portions of the female connector have a substantially equal radius of curvature relative to substantially a same point, wherein the at least two circular portions and the at least two more straight-line-like portions are continuously or smoothly interconnected, and wherein the at least two more straight-line-like portions each comprise a curvature that corresponds to at least 1% of a curvature of the at least two circular portions.

2. The ground drilling rod of claim 1, wherein the rod section comprises the male connector.

3. The ground drilling rod of claim 1, wherein the at least two more straight-line-like portions each has a radius of curvature which is more than 1.5 times larger than a radius of the at least two circular portions.

4. The ground drilling rod of claim 1, wherein the at least two more straight-line-like portions intersect the at least two circular portions and wherein the at least two more straight-line-like portions each has a radius less than a radius of the at least two circular portions.

5. The ground drilling rod of claim 1, wherein the cross section of the male connector or the cross section of the female connector is at least partially configured to be P4C-shaped.

6. The ground drilling rod of claim 1, wherein the cross section of the male connector or the cross section of the female connector has at least one portion on which a contact surface is configured for a securing element of the plug connection.

7. The ground drilling rod of claim 6, wherein the female connector has a through-hole for inserting the securing element.

8. The rod section according to claim 6, wherein the female connector has a through-hole for inserting the securing element, the through-hole being a secant of the cross section of the female connector in a region of the cross-section of the female connector which is formed by a circular portion.

9. The ground drilling rod of claim 1, wherein the rod section has a second end with a second connection that is spaced apart from the first end, the second connection being configured for connection to a further rod section.

10. The ground drilling rod of claim 1, wherein the rod section is a double-pipe rod section.

11. The ground drilling rod of claim 10, wherein the plug connection is present on the outer rod section of the double-pipe rod section.

12. The rod section of claim 1, wherein the at least two more straight-line like portions of the male or female connector have the same radius of curvature.

13. The rod section of claim 1, wherein the at least two more straight-line like portions of the male or female connector are secants on a circle that forms the circular portions.

14. The rod section of claim 1, wherein the cross section of the male connector or the cross section of the female connector is point-symmetrical to the center through which the longitudinal axis of the plug connection or the longitudinal axis of the rod section runs.

15. A method for drilling a borehole in the ground comprising:

providing a ground drilling rod comprising a rod section or ground drilling tool, wherein the rod section or a ground drilling tool is configured at a first end to form a plug connection and wherein the rod section (a) has a male connector or (b) a female connector, and wherein a cross section of the male connector has at least two circular portions and at least two more straight-line-like portions on the outside, or a cross section of the female connector has at least two circular portions and at least two more straight-line-like portions on the inside, wherein the at least two circular portions of the male connector or the at least two circular portions of the female connector have a substantially equal radius of curvature relative to substantially a same point, wherein the at least two circular portions and the at least two more straight-line-like portions are continuously or smoothly interconnected, and wherein the at least two more straight-line-like portions each comprise a curvature that corresponds to at least 1% of a curvature of the at least two circular portions.

16. The method of claim 15, wherein the cross section of the male connector or the cross section of the female connector has at least one portion on which a contact surface his configured for a securing element of the plug connection.

17. A ground drilling rod comprising a ground drilling tool, wherein the ground drilling tool is configured at a first end to form a plug connection and wherein the ground drilling tool has (a) a male connector or (b) a female connector at the first end, wherein the male connector has at least two circular portions and at least two more straight-line-like portion in a cross section on the outside, or the female connector has at least two circular portions and at least two more straight-line-like portions in a cross section on the inside, wherein the at least two circular portions of the male connector or the at least two circular portions of the female connector have a substantially equal radius of curvature relative to substantially a same point, wherein the at least two circular portions and the at least two more straight-line-like portions are continuously or smoothly interconnected, and wherein the at least two more straight-line-like portions each comprise a curvature that corresponds to at least 1% of a curvature of the at least two circular portions.

* * * * *